United States Patent [19]

Dalton

[11] Patent Number: 4,492,242

[45] Date of Patent: Jan. 8, 1985

[54] HEAD SCARF FOR WOMEN WITH HAIR LOSS

[76] Inventor: Betty J. Dalton, 647 N. 16th St., Springfield, Oreg. 97477

[21] Appl. No.: 530,744

[22] Filed: Sep. 9, 1983

Related U.S. Application Data

[63] Continuation of Ser. No. 397,108, Jul. 12, 1982, abandoned.

[51] Int. Cl.[3] ..... A41G 5/00; A42B 5/00

[52] U.S. Cl. ..... 132/53; 2/207

[58] Field of Search ..... 132/53, 54; 2/207, 171, 2/174, 181.2, 182.1, 182.2, 182.6, 183; D28/92, 93

[56] References Cited

U.S. PATENT DOCUMENTS

| | | | |
|---|---|---|---|
| 3,377,628 | 4/1968 | Sante | 2/207 |
| 3,460,546 | 8/1969 | Abbott | 132/53 |
| 3,480,970 | 12/1969 | Gettinger | 2/207 |
| 3,618,140 | 11/1971 | Goldfarb | 2/207 |
| 3,910,292 | 10/1975 | Izzo | 132/53 |
| 4,150,678 | 4/1979 | Photopulos | 132/53 |

*Primary Examiner*—Richard J. Apley
*Assistant Examiner*—Carolyn A. Harrison
*Attorney, Agent, or Firm*—James D. Givnan, Jr.

[57] ABSTRACT

A scarf for wear by persons experiencing a partial hair loss and including a main outer member having a hem along its forward edge. A hair piece is removably attached to the hem to simulate bangs. A fabric retention member serves to maintain the scarf in place on the wearer's scalp. A filler member serves to space the scarf outer member from the head to simulate a scarf worn over a full head of hair.

2 Claims, 4 Drawing Figures

HEAD SCARF FOR WOMEN WITH HAIR LOSS

This is a continuation of application Ser. No. 397,108 filed July 12, 1982, now abandoned.

BACKGROUND OF THE INVENTION

The present invention pertains generally to head attire such as scarves and particularly to a scarf for wear by women experiencing a partial or total hair loss.

A side effect of treating cancer by chemotherapy is partial or total hair loss which is of concern particularly to women who often must resort to the wearing of wigs and accordingly incur a certain amount of inconvenience associated with the maintaining and wearing of wigs. Conventional bandanas or scarves are unsuitable in that when worn by a person with a partial loss of hair they tend to correspond closely to the curvature of the scalp rather than assume the usual or a "full" configuration of a scarf worn over a full head of hair. For women with a hair loss the donning of a wig is not practical for shopping trips or other various outdoor excursions or activities. Further, wigs additionally are somewhat uncomfortable in warm weather.

The known prior art includes a scarf disclosed in U.S. Pat. No. 3,460,546 to which is attachable plural hair pieces secured in a detachable manner and overlying the wearer's head of hair. A fabric type closure is utilized for hair pieces securement to the three-corner scarf. The scarf and the attached hair pieces overlie the wearer's natural hair.

U.S. Pat. No. 3,782,396 discloses a combination wig and hat utilizing a fabric type closure permitting various hat and wig combinations. U.S. Pat. No. 2,651,310 discloses a decorative headband to which is attachable bangs-type hair pieces utilizing various attachment means intermediate the band and hair pieces. U.S. Pat. No. 3,521,648 discloses a stretch wig including a resilient fabric cap to which is secured strands of simulated hair.

SUMMARY OF THE PRESENT INVENTION

The present invention is embodied in a scarf intended for wear by those persons experiencing at least a partial hair loss such as occurs during chemotherapy.

The scarf includes an outer main member to which is attached a filler component which serves to support the main member in spaced relationship to the scalp as if the main member were overlying a full head of hair. The filler component is sewn to the outer main member of the scarf along the forward central area of the latter with the rearwardly extending portion of the filler component being confined loosely about the head by said outer member.

A scarf retention member is of fleece-like fabric, such as quilting fleece, and tends to remain in place on the scalp to prevent accidental displacement of the scarf. Additionally the retention member serves as a barrier to prevent contact of closure material with the scalp. The closure material is used to attach a hair piece, which may be in the shape of bangs, to the underside of the scarf outer member in a detachable manner.

Important objectives of the present scarf include the provision of a scarf for wear by women experiencing some degree of hair loss which includes a filler to shape the scarf outer member to give the appearance of a conventional scarf worn over a full head of natural hair; the provision of a scarf having a main outer fabric member shaped by folds so as to additionally conceal the lower side and rear portions of the head when worn; the provision of a scarf utilizing a fleece-type member coacting with the scalp to assure retention of the scarf in place; the provision of a scarf particularly suited for wear by persons experiencing severe hair losses which may be readily donned to fully conceal the scalp to permit the wearer to feel at ease in public places without the inconvenience of wearing a wig; the provision of a scarf of lightweight washable material which is comfortable to wear even in warmer climates in distinction to the heretofore worn wigs.

DETAILED DESCRIPTION OF THE PREFERRED EMBODIMENT

Figure 1:
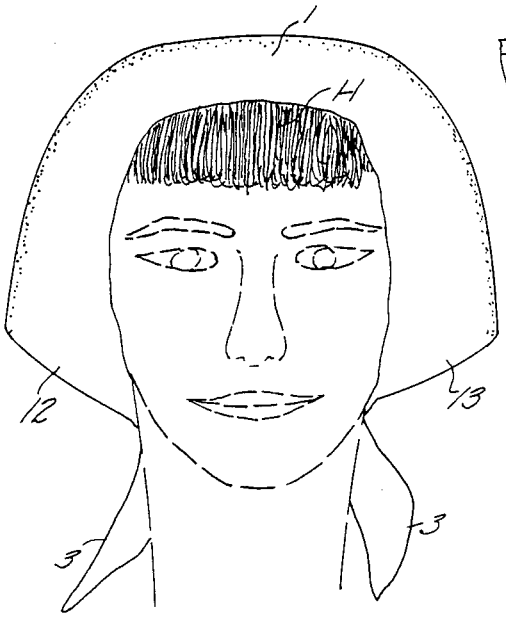
FIG. 1 is a frontal view of the scarf in place on the wearer's head.

With continuing attention to the drawing wherein applied reference numerals indicate parts similarly hereinafter identified, the reference numeral 1 indicates a main or outer scarf member which is initially cut from a triangular piece of cloth with side marginal edges at 1B and 1C.

The main member is folded rearwardly along a forward edge at 1A to provide a facing or hem 2 within which is secured a later described filler. The hem, at its extremities, constitutes ties 3 which, when the scarf is worn, permits knotting of same at the back or base of the head.

A sheet of fabric, termed a filler member, at 4 is secured along a forward margin 4A thereof located intermediate scarf outer member 1 and facing or hem 2 by stitching at 5 which is in the manner of quilt stitching, i.e., intersecting rows of stitching. Body is accordingly given to the uppermost area or crown of the scarf to prevent same from clinging closely to the scalp and temple areas. The sheet of filler material 4 extends rearwardly to underlie (when worn) a substantial portion of the outer or main scarf member 1.

Figure 3:
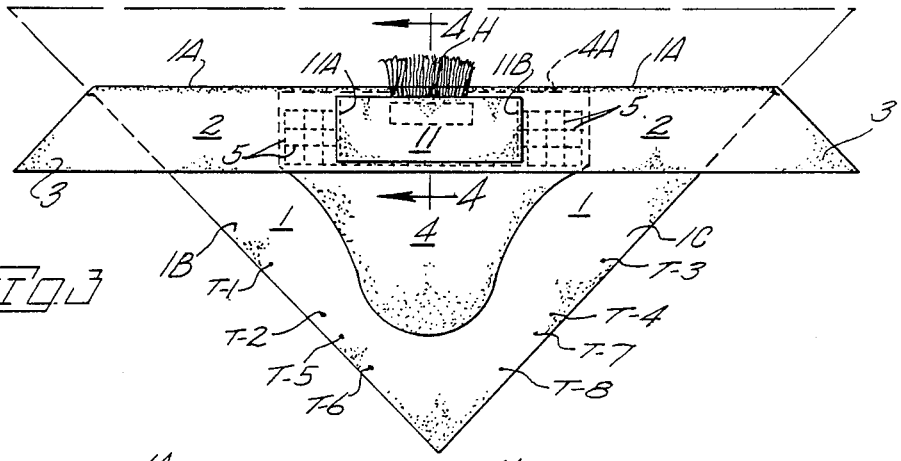
FIG. 3 is a bottom plan view of the scarf.
Figure 4:
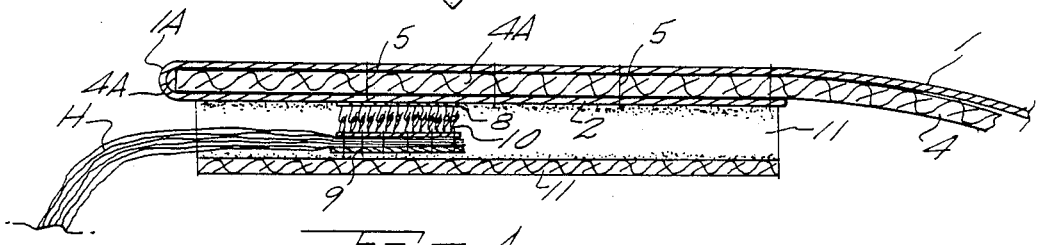
FIG. 4 is a vertical sectional view taken along line 4—4 of FIG. 3.

With attention to FIG. 3, secured to the underside of hem 2, as by stitching, is a fabric closure strip 8 rearwardly offset from the forward folded edge of said hem. A quantity of simulated hair H constituting a hair piece is arranged to resemble natural bangs and is suitably affixed, as by stitching 9, to a cooperating fabric closure strip 10.

A retention member at 11 underlies (when worn) hem 2 and the fabric closure strips 8 and 10 to isolate same from contact with the scalp and, more importantly, to hold the scarf in place on the wearer's scalp. The fabric band is preferably of fleeced nature such as quilting fleece. Two lines of stitching at 11A and 11B secure said band in place on the hem.

Figure 2:
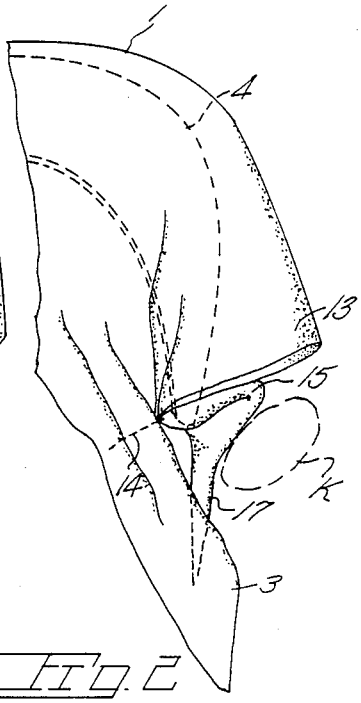
FIG. 2 is a fragmentary side elevational view taken from the right side of FIG. 1 with the scarf ties untied for purposes of illustration.

With attantion again to the scarf outer member at 1, the same is shaped by stitching to conceal the lower sides of the scalp. Outwardly extending folds at 12 and 13 are formed of later described stitching which additionally passes through member 1 and its hem 2. Secondary folds shown typically in FIG. 2 at 15 are inward folds and serve to draw a rear lowermost triangular area 17 of the outer member 1 inwardly against the head and the nape of the neck. Accordingly, the scarf, when tied in place, fully conceals the scalp of the wearer while rendering the appearance of a covering worn over a full head of hair. Outward folds 12 and 13 are formed by the stitching together of points T-1 to T-2 and T-3 to T-4. The smaller inward folds 15 and 16 are formed by stitching together points T-5 to T-6 and T-7 to T-8. As shown in FIG. 2 a line of stitching typically at 14 serves to position the folded areas inwardly adjacent the ties and the lower sides of the head. Accordingly that head area below the scarf is fully concealed from sight. The ties 3 are normally knotted at K at the nape of the neck which further serves to obscure the neck and the head from view.

The fabric closure strips at 8 and 10 may be that type of closure sold under the registered trademark VELCRO.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A scarf for wear by women undergoing chemotherapy to conceal partial or total baldness, said scarf comprising, a main outer cloth member for covering the head of the wearer and having a forward edge and rearwardly converging side marginal edges, a hem formed along the forward edge of said main member, said hem terminating at its ends in ties for tying in a secure manner at the nape of the wearer's neck, a first fabric closure strip stitched in the underside of said hem, a second closure strip for removable attachment to said first closure strip, a hair piece simulating bangs, said hair piece stitched to said second fabric closure strip and projecting forwardly beyond said hem when the scarf is worn to simulate bangs, an elongate fleeced fabric retention member attached at its ends to said hem at locations oppositely offset from the ends of said first closure strip, said retention member for contact with the wearer's scalp to retain scarf against slipping and further serving to isolate the first closure strip from injurious scalp contact while allowing access to the first closure strip attachment and for hair piece removal purposes, a fabric filler sheet secured along its forward boundary between said main outer cloth member and said hem and having a rearwardly extending, unattached portion adapted to fully and loosely drape over the wearer's scalp to impart the illusion to a viewer that the scarf outer cloth member is in place over a full head of hair, and said rearwardly converging side marginal edges of the main outer member each having permanent folds formed therein by stitching each marginal edge at intervals to draw the main outer member of the scarf when worn against the nape of the wearer's neck to fully conceal the scalp.

2. The scarf claimed in claim 1 wherein said fabric filler sheet is sewn to said hem and said main outer cloth member by rows of intersecting lines of stitching to provide a quilted appearance which contributes to the impression that the scarf is worn over a full head of hair.

* * * * *